US009420839B2

(12) United States Patent
Shirai

(10) Patent No.: US 9,420,839 B2
(45) Date of Patent: Aug. 23, 2016

(54) AIR PERMEABLE HEADWEAR

(71) Applicant: BUILMATEL CO., LTD., Chuo-ku, Tokyo (JP)

(72) Inventor: Syoji Shirai, Tokyo (JP)

(73) Assignee: BUILMATEL CO., LTD., Tokyo (JP)

( * ) Notice: Subject to any disclaimer, the term of this patent is extended or adjusted under 35 U.S.C. 154(b) by 0 days.

(21) Appl. No.: 14/369,533

(22) PCT Filed: Sep. 5, 2013

(86) PCT No.: PCT/JP2013/073897
§ 371 (c)(1),
(2) Date: Jun. 27, 2014

(87) PCT Pub. No.: WO2014/061364
PCT Pub. Date: Apr. 24, 2014

(65) Prior Publication Data

US 2015/0000008 A1 Jan. 1, 2015

(30) Foreign Application Priority Data

Oct. 19, 2012 (JP) ..... 2012-231463
Feb. 20, 2013 (JP) ..... 2013-031575

(51) Int. Cl.
*A42B 1/00* (2006.01)
*A42B 3/28* (2006.01)
(Continued)

(52) U.S. Cl.
CPC ..... *A42B 1/008* (2013.01); *A42B 1/062* (2013.01); *A42B 1/22* (2013.01); *A42B 3/28* (2013.01); *A42C 5/04* (2013.01)

(58) Field of Classification Search
CPC ..... A42B 3/28; A42B 3/22; A42B 1/002; A42B 1/008; A42B 1/02; A42B 1/062; A42B 1/063; A42B 1/064; A42B 1/00
USPC ..... 2/410, 6.6, 7, 418, 171.3, 182.1, 182.2, 2/182.3, 184.5, 209.5, 209.7, 195.5, 2/195.6, 200.1
See application file for complete search history.

(56) References Cited

U.S. PATENT DOCUMENTS 654,432 A * 7/1900 Borrow et al. ..... A42C 5/04 2/182.7
1,036,004 A * 8/1912 Revell ..... A42C 5/04 2/184.5

(Continued)

FOREIGN PATENT DOCUMENTS

JP 56095538 U 7/1981
JP 57027427 U 2/1982

(Continued)

OTHER PUBLICATIONS

International Search Report (ISR) dated Nov. 5, 2013 in International Application No. PCT/JP2013/073897.

*Primary Examiner* — Alissa L Hoey
(74) *Attorney, Agent, or Firm* — Holtz, Holtz & Volek PC

(57) ABSTRACT

Provided is a baseball cap-type headwear in which a peak is provided in a front lower end of a head circumferential portion and a crown is connected to an upper end of the head circumferential portion, in which a front portion of the head circumferential portion is formed as an inclined surface that widens in an outward direction of the headwear as the inclined surface advances toward a lower end, a void is formed between the peak and the head circumferential portion, and the central portion of one end of the peak is positioned on an inner side of the headwear more than the front lower end of the head circumferential portion, and at least the front portion of the head circumferential portion and the peak are integrally molded from a synthetic resin.

5 Claims, 10 Drawing Sheets

(51) Int. Cl.

| | |
|---|---|
| ***A42B 1/22*** | (2006.01) |
| ***A42C 5/04*** | (2006.01) |
| ***A42B 1/06*** | (2006.01) |

(56) References Cited

U.S. PATENT DOCUMENTS

| | | | | |
|---|---|---|---|---|
| 1,748,375 | A * | 2/1930 | Wittcoff | A42B 1/02 2/10 |
| 2,058,146 | A * | 10/1936 | Glidden | A42B 3/06 2/418 |
| 2,286,202 | A * | 6/1942 | Fischer | A42B 1/06 2/173.5 |
| 2,684,484 | A * | 7/1954 | Rossman | A42B 1/22 2/195.4 |
| 2,684,485 | A * | 7/1954 | Rossman | A41F 1/008 2/195.2 |
| 3,391,407 | A * | 7/1968 | Waters | A42B 3/286 2/171.3 |
| 3,594,814 | A * | 7/1971 | Schuessler | A42B 3/105 2/205 |
| 3,631,539 | A * | 1/1972 | Massa | A42B 1/22 2/195.2 |
| 4,114,201 | A * | 9/1978 | Garrison | A42C 5/04 2/209.7 |
| 4,274,157 | A * | 6/1981 | Boden | A42C 5/04 2/181.4 |
| 4,476,589 | A * | 10/1984 | Burgin | A42C 5/04 2/184.5 |
| 4,550,445 | A * | 11/1985 | Fender | A42B 1/06 2/181.6 |
| 4,999,846 | A * | 3/1991 | Ball | A42B 1/22 2/417 |
| 5,117,506 | A * | 6/1992 | Byrnes | A42B 3/227 2/10 |
| 5,253,364 | A * | 10/1993 | Robinson | A42B 1/064 2/10 |
| 5,855,023 | A * | 1/1999 | Clingenpeel | A42C 5/04 2/181.6 |
| 5,907,871 | A * | 6/1999 | Austin | A42B 1/006 2/181 |
| 6,199,214 | B1 * | 3/2001 | Campbell | A42B 3/28 2/181.6 |
| 6,367,084 | B1 | 4/2002 | Keast | |
| 6,370,697 | B1 * | 4/2002 | Held | A42C 5/04 2/184.5 |
| 6,457,210 | B1 * | 10/2002 | Shirai | A41F 1/008 24/16 PB |
| 6,526,595 | B2 * | 3/2003 | Held | A42C 5/04 2/184.5 |
| 6,598,237 | B2 * | 7/2003 | Held | A42C 5/04 2/184.5 |
| 6,691,322 | B2 * | 2/2004 | Held | A42C 5/04 2/184.5 |
| 7,237,274 | B2 * | 7/2007 | Cote | A42C 5/04 2/181 |
| 7,398,560 | B1 * | 7/2008 | Swensen | A42C 5/04 2/182.2 |
| D616,181 | S * | 5/2010 | Harada | D2/891 |
| 7,818,821 | B2 * | 10/2010 | Shirai | A42B 3/281 2/410 |
| 8,136,169 | B2 * | 3/2012 | Taylor | A42B 1/008 2/171.3 |
| 8,146,211 | B2 * | 4/2012 | Shirai | A41F 1/008 24/16 PB |
| 8,516,617 | B1 * | 8/2013 | Kazmierczak | A42C 5/04 2/171.3 |
| 8,640,264 | B2 * | 2/2014 | Ramer | A42B 1/062 2/171.3 |
| 8,650,665 | B2 * | 2/2014 | Shirai | A41F 1/008 2/183 |
| 8,782,815 | B2 * | 7/2014 | Greene, Jr. | A42B 1/062 2/171.3 |
| 2004/0006807 | A1 * | 1/2004 | Wang | A42B 1/062 2/195.1 |
| 2006/0005302 | A1 * | 1/2006 | Stephenson | A42B 7/00 2/410 |
| 2006/0179543 | A1 * | 8/2006 | Burmester | A42B 1/002 2/171 |
| 2006/0230506 | A1 * | 10/2006 | Shirai | A42B 3/281 2/410 |
| 2009/0241240 | A1 * | 10/2009 | Han | A42B 1/062 2/182.8 |
| 2009/0288238 | A1 * | 11/2009 | Greene, Jr. | A42B 1/062 2/171.3 |
| 2010/0017941 | A1 * | 1/2010 | Taylor | A42B 1/008 2/171.3 |
| 2010/0175232 | A1 * | 7/2010 | Shirai | A41F 1/008 24/641 |
| 2010/0186135 | A1 * | 7/2010 | Keillor | A42B 3/285 2/7 |
| 2011/0016611 | A1 * | 1/2011 | Rogers | A42C 5/04 2/171.3 |
| 2012/0000006 | A1 * | 1/2012 | Ramer | A42B 1/062 2/171.3 |
| 2013/0212776 | A1 * | 8/2013 | Kim | A42B 1/062 2/171.7 |
| 2013/0239292 | A1 * | 9/2013 | Greene, Jr. | A42B 1/062 2/171.3 |
| 2013/0263358 | A1 * | 10/2013 | Fleischmann | A42B 1/008 2/182.8 |

FOREIGN PATENT DOCUMENTS

| | | | |
|---|---|---|---|
| JP | 61043228 | U | 3/1986 |
| JP | 2006089879 | A | 4/2006 |
| JP | 4516689 | B2 | 8/2010 |
| JP | 2013019088 | A | 1/2013 |

* cited by examiner

AIR PERMEABLE HEADWEAR

TECHNICAL FIELD

The present invention relates to a headwear that has secured air permeability, has a good exterior appearance and a high degree of freedom in design, and has improved production efficiency.

BACKGROUND ART

In the related art, a headwear having ventilation holes in its body, a headwear in which a mesh material is used in a part or an entire part of the fabric of the body, and other headwears are known as air permeable headwears.

According to a method of forming ventilation holes in the body, although ventilation holes having a diameter of approximately 1 mm to 5 mm are formed at a number of appropriate positions, since the ventilation holes are small, it is difficult to secure air permeability sufficient for giving a sense of refreshing feeling. Moreover, when a mesh material is used in a part of the fabric of the body, although it is possible to secure air permeability, since sunlight reaches directly the portion formed of a mesh material, the wearer cannot experience a sense of sufficiently refreshing feeling. Further, when ventilation holes are formed in the body and a mesh material is used in a part of the fabric of the body, the appearance is not satisfactory.

Patent Document 1 discloses a headwear in which ventilation portions are formed in a front surface of the crown and a length adjustment belt having a bag-shaped central portion and configured to receive a sweat absorbing mechanism and other heat absorbing mechanisms as necessary is attached to a front-half portion of the inner circumference of the lower end of the crown. According to this invention, although air incoming from the ventilation portions flows downward from voids appearing between the front surface of the belt and the inner circumferential surface of the crown, countermeasures against the sun glare and the foreign materials entering from the ventilation portions are not taken.

Moreover, when the length adjustment belt is tightly fastened to the forehead, since voids appear between the front surface of the belt and the inner circumferential surface of the crown and air incoming from the ventilation portions of the crown flows downward from the voids, the forehead is cooled with the flowing air and wetting and sweating of the head can be prevented. However, since one end of the belt except the bag-shaped portion is sewn to an inner circumferential end of the crown and the other end protrudes outward from the other circumferential end so as to be connected to an adjuster, the adjuster appears on the exterior appearance of the headwear. Moreover, it is difficult to attach the belt to the headwear.

Patent Document 2 discloses a headwear in which an inlet aperture for introducing air into the headwear is provided in the front of the crown above the level of the peak, a baffle or a blade is provided so as to be suspended from an upper edge of the inlet aperture, and an outlet aperture is provided in an occipital region of the crown. According to this invention, a mild turbulence created by the baffle or the blade in a region extending from the inlet aperture to the outlet aperture covers the top of the head of the wearer of the headwear to thereby create a cooling effect. However, since outside air from the front of the headwear is blocked by the baffle or the blade, the outside air will not come into direct contact with the forehead of the head of the wearer of the headwear, which is a region most sensitive to cool air.

Moreover, in this invention, since the aperture is formed of a fabric, it is impossible to reliably maintain the aperture.

In Japanese Unexamined Patent Application Publication No. 2013-019088 (Patent Document 3), the present inventor has proposed a headwear in which an aperture is formed in the front and rear portions of the body and a louver mechanism including a louver frame and a blade plate is fixed to the aperture as a headwear which has air permeability and light shading properties and an excellent exterior design. Since the headwear of this invention has air permeability and light shading properties, the wearer can experience a sense of sufficiently refreshing feeling. However, since apertures need to be formed in the body and the louver mechanism needs to be fixed to the apertures, it is difficult to manufacture the headwear and the headwear is not appropriate for mass production.

Patent Document 1: Microfilm of Japanese Utility Model Registration Application No. S55-100319 (Japanese Unexamined Utility Model Registration Application, Publication No. 557-027427)

Patent Document 2: Japanese Patent No. 4516689

Patent Document 3: Japanese Unexamined Patent Application, Publication No. 2013-019088

DISCLOSURE OF THE INVENTION

Problems to be Solved by the Invention

The present invention provides a headwear which is capable of securing both air permeability and light shading properties and which can be easily manufactured. The outside air comes into direct contact with the forehead of the head of the wearer of the headwear, which is a region most sensitive to cool air, whereby a cooling effect is enhanced.

Moreover, the present invention provides a louver-attached headwear which has secured air permeability and has good exterior appearance and a high degree of freedom in design.

Means for Solving the Problems

A headwear of the present invention is a baseball cap-type headwear in which a peak is provided in a front lower end of a head circumferential portion and a crown is connected to an upper end of the head circumferential portion, in which a front portion of the head circumferential portion is formed as an inclined surface that widens in an outward direction of the headwear as the inclined surface advances toward a lower end, the front lower end of the head circumferential portion is connected to both sides of one end of the peak but is not connected to a central portion of one end of the peak so that a void is formed between the peak and the head circumferential portion, and the central portion of one end of the peak is positioned on an inner side of the headwear more than the front lower end of the head circumferential portion, and at least the front portion of the head circumferential portion and the peak are integrally molded from a synthetic resin.

Preferably, the front portion and both sides of the head circumferential portion and the peak are integrally molded from a synthetic resin.

Preferably an entire circumference of the head circumferential portion and the peak are integrally molded from a synthetic resin.

Preferably, the headwear is a baseball cap-type headwear in which a slide adjuster is provided on an inner side of the head circumferential portion, the slide adjuster includes a band and a buckle which are formed from a synthetic resin, a sawtooth-shaped engagement groove formed on an outer surface of the band engages with an engagement claw of the buckle, and in the engagement state, the band can freely advance in relation to the buckle but cannot retract, the buckle includes a buckle body which includes a bottom plate, a roof frame facing the bottom plate, and both side plate connecting the bottom plate and the roof frame, and in which an insertion space for the band is provided and an operating board which is provided horizontally on an inner side of the roof frame and in which an engagement claw is formed on a lower surface of one end thereof so as to engage with the engagement groove of the band and a pressing portion for disengaging the engagement is provided on the other end, and the operating board is supported by a connecting shaft that is provided at an intermediate position between the engagement claw and the pressing portion so as to connect with both side plates or the roof frame so that the operating board can freely swing about the intermediate position, a height of the pressing portion is the same as or lower than the roof frame, and the buckle is fixed to an inner side of the head circumferential portion with the roof frame interposed.

Preferably, the band and the head circumferential portion are integrally molded from a synthetic resin.

A headwear of the present invention is a headwear in which a peak is provided on a front side, in which the peak and a head circumferential portion are integrally molded from a synthetic resin, a louver for introducing air into a headwear body along a surface of the peak is provided on the peak, and a size adjustment belt is provided on an inner side of the head circumferential portion closer to the peak.

Preferably, an attachment portion for attaching the size adjustment belt is provided on the inner side of the head circumferential portion.

Preferably, the size adjustment belt is molded integrally with the head circumferential portion.

Preferably, a size adjustment mechanism of the size adjustment belt is an american hook-type adjuster.

Preferably, a size adjustment mechanism of the size adjustment belt is a slide adjuster.

Effects of the Invention

In the headwear according to the present invention, the front lower end of the head circumferential portion is connected to both sides of one end of the peak but is not connected to the central portion of one end of the peak so that the void is formed between the peak and the head circumferential portion, and at least the front portion of the head circumferential portion and the peak are integrally molded from a synthetic resin. Due to this, it is possible to secure a void easily between the peak and the head circumferential portion. Moreover, since the central portion of one end of the peak is positioned on the inner side of the headwear more than the front lower end of the head circumferential portion, outside air is introduced into the headwear from the void along the peak and makes direct contact with the forehead of the head of the wearer, which is a region most sensitive to cool air. Thus, a cooling effect is improved remarkably. Further, since the front portion of the head circumferential portion is formed as an inclined surface that widens in an outward direction of the headwear as the inclined surface advances toward the lower end, it is possible to prevent entering of sunlight or a foreign material from the void. In addition, since the headwear according to the present invention is configured such that the crown is connected to the upper end of the head circumferential portion, it is very easy to manufacture the headwear.

Further, according to the headwear in which the size adjustment belt is provided on the inner side of the head circumferential portion closer to the peak, a size adjustment mechanism such as a slide adjuster does not appear outside, and the gap in the front portion of the headwear is concealed by the peak. Thus, a degree of freedom in design is provided.

EXPLANATION OF REFERENCE NUMERALS

Figure 1A:
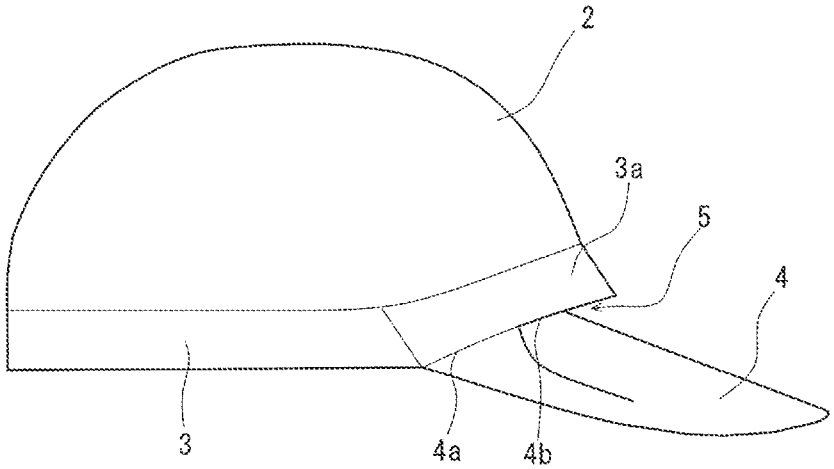
FIG. 1A is a side view of a headwear of the present invention.

2: Crown
3: Head circumferential portion
3*a*: Front portion of head circumferential portion
4: Peak
4*a*: Both sides of one end of peak
4*b*: Central portion of one end of peak
5: Void
6: Gap
7: Louver
8: Slide adjuster
9: Size adjustment belt
10: Band
12: Engagement groove
20: Buckle
22: Roof frame
24: Buckle body
30: Operating board
31: Engagement claw
32: Pressing portion
40A: One end of size adjustment belt
40B: The other end of size adjustment belt

PREFERRED MODE FOR CARRYING OUT THE INVENTION

Hereinafter, embodiments of an air permeable headwear according to the present invention will be described based on the drawings.

Figure 1B:
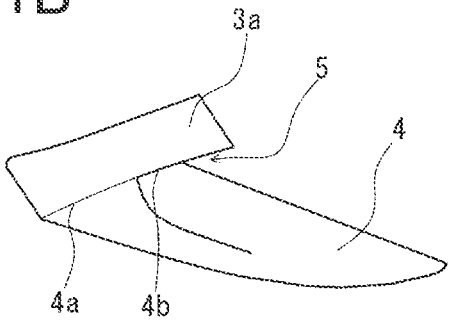
FIG. 1B is a side view illustrating a front portion of a head circumferential portion and the peak separated from the crown.

FIG. 1A is a side view of a headwear according to the present invention and illustrates a crown 2, a head circumferential portion 3, and a peak 4 that constitute the headwear. FIG. 1B is a side view illustrating a front portion 3*a* of the head circumferential portion and the peak 4 separated from the crown 2.

The peak 4 is provided in a front lower end of the head circumferential portion 3 and the crown 2 is connected to the upper end of the head circumferential portion 3. The front portion 3*a* of the head circumferential portion 3 and the peak 4 are integrally molded from a synthetic resin, and the crown 2 is connected to the upper end of the head circumferential portion 3 by sewing or the like.

The front portion 3*a* of the head circumferential portion 3 is formed as an inclined surface that widens in an outward direction of the headwear as the inclined surface advances toward the lower end. Due to this, it is possible to prevent sunlight and a foreign material from entering into the headwear from a void described later. Although the angle of the front portion 3*a* of the head circumferential portion 3 is not particularly limited, the front portion 3*a* may have such an angle that entering of sunlight and a foreign material can be effectively prevented.

The lower end of the front portion 3*a* of the head circumferential portion 3 is connected to both sides 4*a* at one end of the peak 4 and is not connected to a central portion 4*b* of one end of the peak 4. Due to this, a void 5 is formed between the peak 4 and the head circumferential portion 3.

Since the front portion 3*a* of the head circumferential portion 3 and the peak 4 are integrally molded from a synthetic resin, the void 5 is reliably secured in the front portion of the headwear. Moreover, by just connecting the crown 2 to the upper end of the head circumferential portion 3, it is possible to easily manufacture a headwear having the void 5 between the front portion 3*a* of the head circumferential portion 3 and the peak 4.

As a material of the front portion 3*a* of the head circumferential portion 3 and the peak 4, a synthetic resin such as polyester, polypropylene, polyethylene, polycarbonate, or ABS resin can be used. The front portion 3*a* of the head circumferential portion 3 and the peak 4 can be easily integrally molded using a mold due to having a simple structure. FIG. 1B is a side view illustrating the front portion 3*a* of the head circumferential portion 3 and the peak 4 molded integrally, separated from the crown 2.

Figure 2:
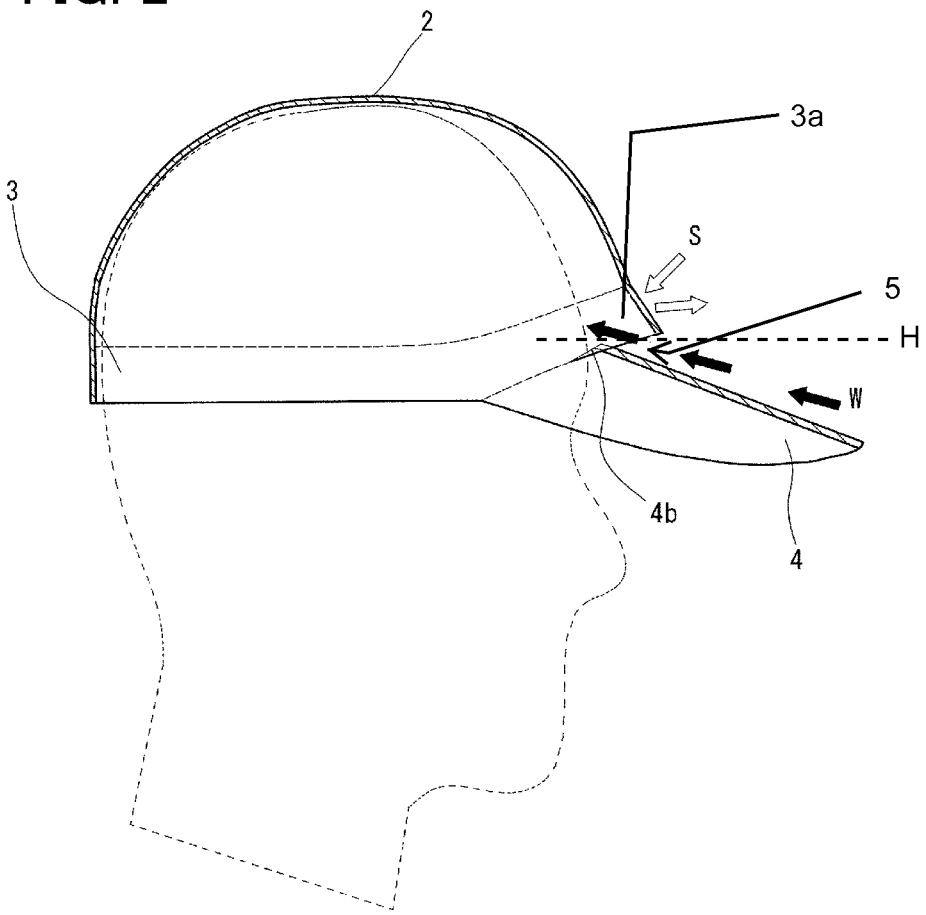
FIG. 2 is a vertical sectional side view illustrating a wearing state of the headwear illustrated in FIG. 1A.

Subsequently, the action of the headwear according to the present invention will be described using FIG. 2. FIG. 2 is a vertical sectional side view illustrating a wearing state of the headwear illustrated in FIG. 1A.

Since the central portion 4*b* of one end of the peak 4 is positioned on the inner side of the headwear more than the lower end of the front portion 3*a* of the head circumferential portion 3, outside air W from the front side of the headwear is introduced into the headwear from the void 5 along the upper portion of the peak 4 without being blocked in the midway. In the present embodiment, as clearly shown in FIG. 2, only the central portion 4*b* of one end of the peak 4 is laterally positioned to an interior of the lower end of the front portion 3*a* of the head circumferential portion 3. In addition, as shown in FIG. 2, a horizontal axis H bisects the void 5. A portion of the lower end of the front portion 3*a* of the head circumferential portion 3 that is not connected to the central portion 4*b* of the one end of the peak 4 has an outermost portion that is positioned entirely above the horizontal axis H. And as shown in FIG. 2, an entirety of the peak 4, including the central portion 4*b* of the one end of the peak 4, is positioned entirely below the horizontal axis H, and a top surface of the peak 4 is downwardly inclined with respect to the horizontal axis H and forms a straight line from an upper end thereof to a lower end thereof when viewed in side view. Furthermore, as shown in FIG. 2, the peak 4 extends laterally from the interior to an exterior of the lower end of the front portion 3*a* of the head circumferential portion 3 such that the peak extends beyond an outermost point of the lower end of the front portion 3*a* of the head circumferential portion 3 in a horizontal direction. Yet still further, as shown in FIG. 2, the outermost point of the lower end of the front portion 3*a* of the head circumferential portion 3 and an uppermost point of the peak 4 define the void 5 situated therebetween.

According to the present invention, since a large amount of outside air W flowing into the headwear along the peak 4 from the void 5 comes into direct contact with the forehead of the head of the wearer of the headwear, which is a region most sensitive to cool air, and sunlight S is blocked by the front portion 3*a* of the head circumferential portion, the wearer can experience an excellent cooling effect. Moreover, since the front portion 3*a* of the head circumferential portion and the peak 4 are integrally molded from a synthetic resin, it is possible to reliably secure the void 5.

In the present embodiment, although the front portion 3*a* of the head circumferential portion 3 and the peak 4 are integrally molded from a synthetic resin, the entire circumference of the head circumferential portion 3 and the peak 4 may be integrally molded from a synthetic resin. In this case, since the entire circumference of the head circumferential portion 3 serving as the base of the headwear is formed from a synthetic resin, the shape of the entire headwear having the void 5 is maintained.

Moreover, when the size adjustment mechanism is provided in the rear portion of the headwear, the front portion 3*a* and both side portions of the head circumferential portion 3 and the peak 4 may be integrally molded from a synthetic resin.

Figure 3:
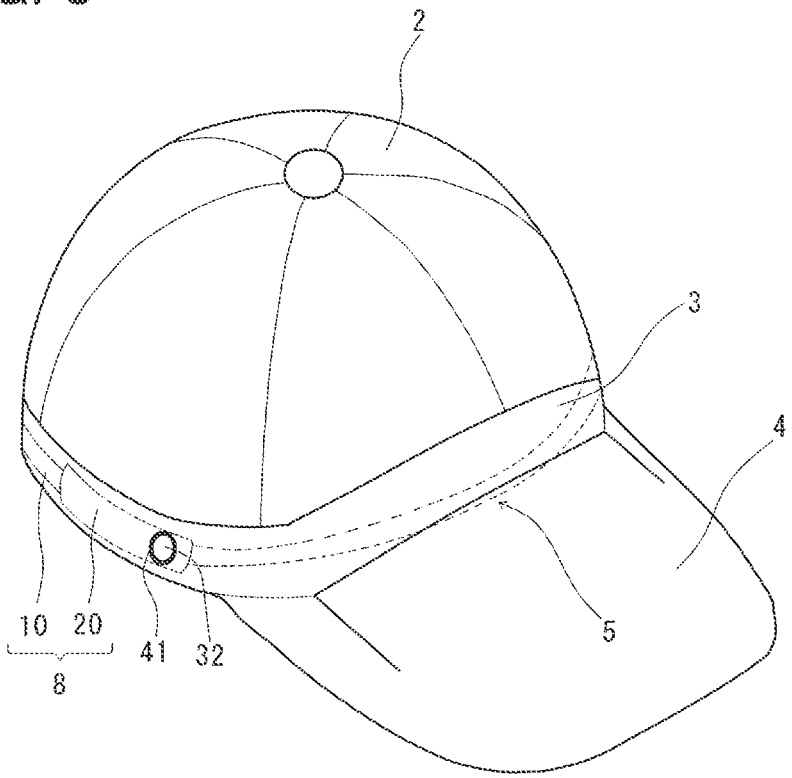
FIG. 3 is a perspective view of a headwear according to another embodiment of the present invention, illustrating a slide adjuster provided on the inner side of a head circumferential portion when seen from above a left front portion of the headwear.

Next, another embodiment of the present invention will be described with reference to FIG. 3.

In this embodiment, a slide adjuster 8 is provided on the inner side of the head circumferential portion 3. FIG. 3 is a perspective view of the slide adjuster 8 when seen from above the left front portion of the headwear, illustrating a crown 2, a head circumferential portion 3, and a peak 4 that constitute the headwear. The peak 4 is provided in the front lower end of the head circumferential portion 3, and the crown 2 is connected to the upper end of the head circumferential portion 3. The entire circumference of the head circumferential portion 3 and the peak 4 are integrally molded from a synthetic resin, and the crown 2 is connected to the upper end of the head circumferential portion 3 by sewing or the like.

The slide adjuster 8 provided on the inner side of the head circumferential portion 3 includes a band 10 and a buckle 20 as will be described with reference to FIG. 4A, and the buckle 20 is fixed to the inner side of the head circumferential portion 3 by a roof frame.

Although the fixing is generally realized by sewing, the fixing is not limited to this, and fixing means such as caulking and an adhesive may be used. Since the band 10 and the buckle 20 may be provided in an optional position in the circumferential direction of the head circumferential portion 3, a disengagement pressing portion 32 described later may be provided at an optional position of the head circumferential portion 3.

Subsequently, the slide adjuster 8 will be described with reference to FIGS. 4A, 4B, and 4C.

Figure 4A:
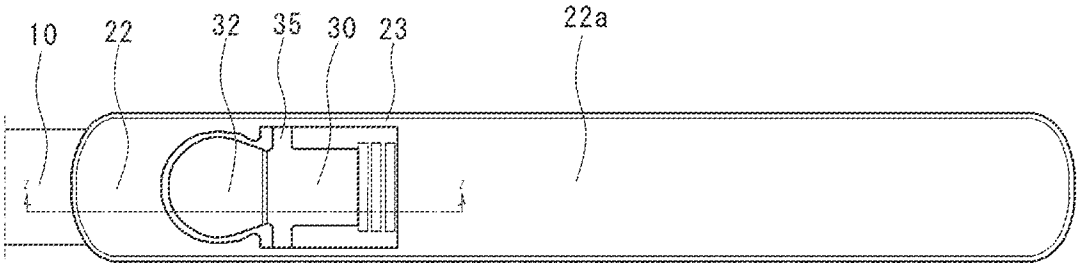
FIG. 4A is a plan view of a slide adjuster including a band and a buckle.
Figure 4B:
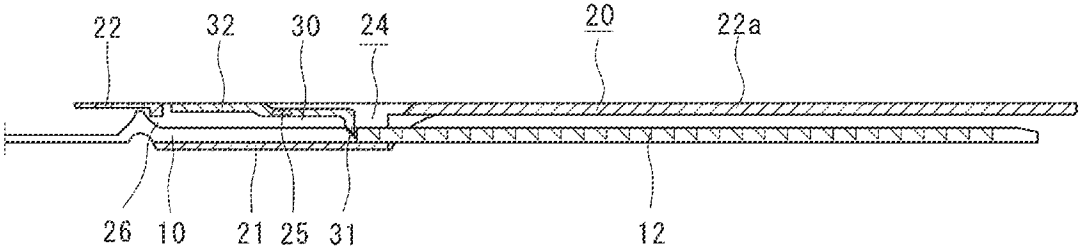
FIGS. 4B and 4C are vertical sectional side views taken along line z-z.

FIG. 4A illustrates a plan view in a slide adjuster including the band 10 and the buckle 20 and FIG. 4B is a vertical sectional side view along line z-z in FIG. 4A.

In these figures, a sawtooth-shaped engagement groove 12 is formed on the outer surface of the band 10 having necessary length, width, and thickness so as to extend from a distal end (a portion close to the buckle 20) to a terminating end of the band 10.

A main body of the buckle 20 includes a bottom plate 21, a roof frame 22 facing the bottom plate 21, and a flat and cylindrical buckle body 24 that includes side plates 23 connecting the bottom plate 21 and the roof frame 22. A portion of the buckle body 24 in which the band 10 slides is open as an insertion opening, and the inside thereof serves as an insertion space 26 of the band 10.

Since the roof frame 22 constituting the buckle body 24 is formed as a flat plate, the buckle 20 is easily attached to the sweatband. Due to this, it is possible to mass-produce the headwear according to the present invention without incurring much labor and cost.

Figure 4C:
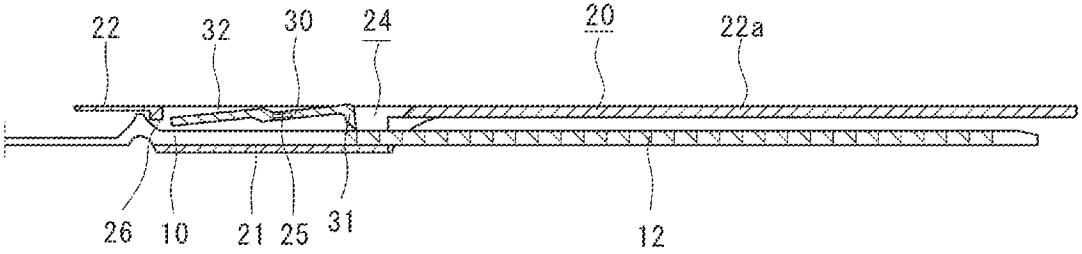

In FIGS. 4A, 4B, and 4C, although the pressing portion 32 is formed in a small circular form so that the pressing portion 32 is easily pressed by a finger tip of one hand, the pressing portion 32 is not limited to this but may be formed in an angular form.

In FIGS. 4A, 4B, and 4C, a reference numeral 22*a* is a portion of the roof frame 22 facing one end of an operating board 30 and is formed so as to extend horizontally in a direction opposite to the operating board 30. With the roof frame 22*a*, the buckle 20 is reliably fixed to the inner side of the head circumferential portion 3 and the front end of the buckle 20 advances along the lower surface (the surface facing the bottom plate 21) of the roof frame 22*a* during sliding of the band 10. Thus, the roof frame 22*a* also performs the role of a slide guide and a sheath.

When the extension length of the roof frame 22*a* has approximately the same length as the band 10, the length of the slide guide and the sheath is sufficient.

On the other hand, in the present embodiment, since the entire circumference of the head circumferential portion 3 is molded from a synthetic resin, the head circumferential portion 3 itself may perform the role of a slide guide and a sheath and an optional portion of the roof frame 22 may be formed as a flat plate.

The operating board 30 having such a size that the operating board 30 is received in the roof frame 22 is provided horizontally on the inner side of the roof frame 22. An engagement claw 31 configured to engage with the engagement groove 12 of the band 10 protrudes from the lower surface of one end of the operating board 30, and the upper surface of the other end of the operating board 30 serves as the disengagement pressing portion 32. Since the height of the pressing portion 32 is the same as or lower than the roof frame 22, even when the headwear is worn with the buckle 20 fixed to the head circumferential portion 3, it is possible to prevent careless disengagement.

A connecting shaft 35 is formed in an intermediate position in the longitudinal direction of the operating board 30, and the connecting shaft 35 is connected to upper inner walls of both side plates 23. The cross-sectional shape of the connecting shaft 35 may be a circular shape, an elliptical shape, and other various shapes. The connecting shaft 35 may have an optional shape as long as the connecting shaft 35 supports the operating board 30 so as to freely swing and is not broken after repeated swinging. Even when the connecting shaft 35 is supported by two sides of the roof frame 22 facing the operating board 30 without being limited to both side plates 23, the same effects as described later can be obtained.

The band 10 and the buckle 20 are preferably molded from a flexible synthetic resin. When the band 10 is formed from a synthetic resin, the band 10 can smoothly slide on the lower surface of the roof frame 22*a* or the inner side of the head circumferential portion 3.

Moreover, in order to allow the operating board 30 to swing about the connecting shaft 35, the buckle 20 is preferably molded from an elastic synthetic resin such as polyacetal, polyoxymethylene, polyamide, or polycarbonate. This buckle 20 is formed of a small number of components and can be easily integrally molded using a mold due to having a simple structure.

Next, the action of the headwear illustrated in FIG. 3 will be described.

When one wants to adjust the size of a headwear, the band 10 exposed to the inner side of the head circumferential portion 3 may be directly held with fingertips of one hand, a portion of the head circumferential portion 3 in which the slide adjuster 8 is provided may be held by fingertips of the other hand, and both hands may approach each other.

Although the size of the headwear can be decreased with this operation, even when both hands are detached, the size of the headwear will not increase due to the action of the slide adjuster 8 described later. When one wants to increase the size of the headwear, the pressing portion 32 of the slide adjuster 8 may be pressed by fingertips or the like.

Figure 5:
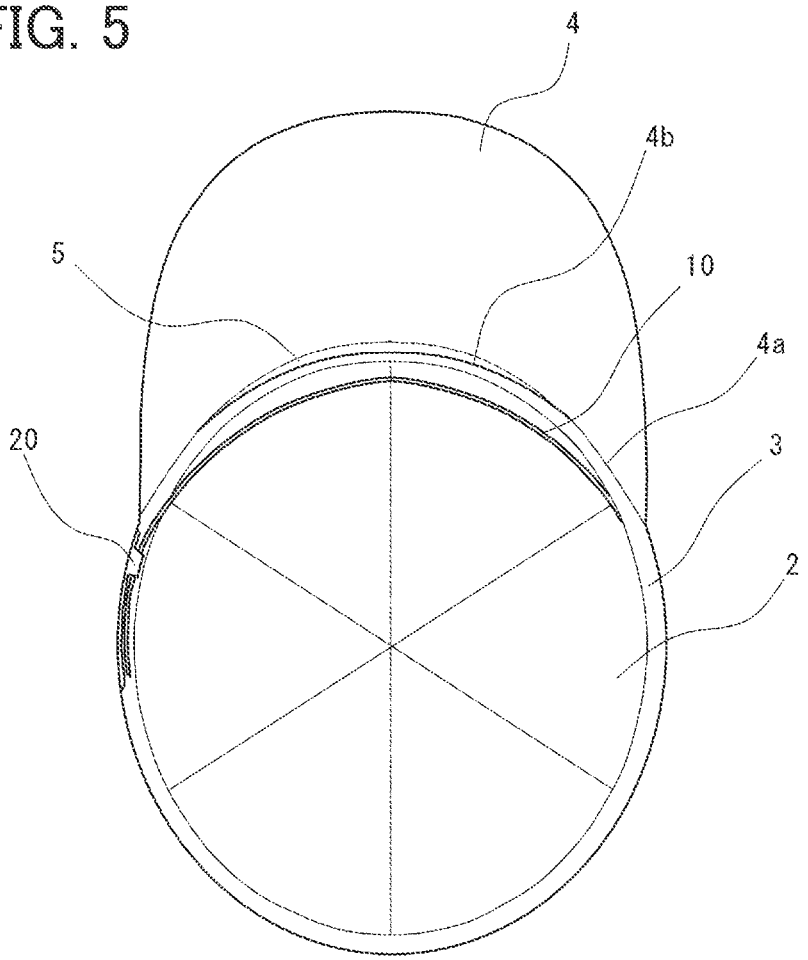
FIG. 5 is a bottom view of the headwear illustrated in FIG. 3.

When the headwear of the present embodiment is worn, although the band 30 makes contact with the forehead but the headwear does not make contact with the forehead, and a gap is formed between the forehead and the headwear (see FIG. 5). Thus, when outside air enters into the headwear from the void 5, the outside air makes direct contact with the forehead and warm air stored inside the headwear body is discharged outside the headwear body from the gap with the flow of the outside air.

Moreover, since the band 30 makes contact with the forehead, the headwear provides a good wearing feeling (in particular, a fitting feeling). Moreover, even when the central portion 4*b* of one end of the peak 4 protrudes toward the inner side of the headwear, it is possible to prevent the peak 4 from making contact with the forehead.

Further, a limited region makes contact with the hair, even when the headwear is worn, mess-up of the hair can be reduced remarkably.

In the present embodiment, an aperture 41 is formed in a portion of the head circumferential portion 3 corresponding to the pressing portion 32 of the slide adjuster 8, and the pressing portion 32 is visible from the aperture 41. Thus, the disengagement between the band 10 and the buckle 20 can be realized smoothly.

Next, the action of the slide adjuster will be described. FIG. 4B illustrates a state where the band 10 is inserted in the insertion space 26 of the buckle 20 and the engagement claw 31 of the buckle 20 engages with the engagement groove 12 formed on the outer surface of the band 10. The cross-sectional shape in the sliding direction of the engagement groove 12 is a sawtooth shape (that is, a shape formed by a tapered surface of which the depth gradually increases in the advancing direction of the band 10 and a wall surface that rises approximately vertically from the deepest position.

When the band 10 advances into the insertion space 26 of the buckle body 24 from the side (the left side in FIG. 4B) of the pressing portion 32, the upper surface of the band 10 makes contact with the engagement claw 31 of the operating board 30 and advances while pushing up one end (the side where the engagement claw 31 is formed) of the operating board 30, and the approaching and separation positions of the band 10 in relation to the buckle 20 are adjusted. In this state, as illustrated in FIG. 4B, since the engagement claw 31 and the predetermined engagement groove 12 are engaged and locked, the band 10 can freely advance in relation to the buckle 20 but cannot retract.

On the other hand, when one wants to retract or pull the band 10 from the buckle 20, the pressing portion 32 of the operating board 20 is lightly pressed by fingers. As a result, the operating board 30 rotates about the connecting shaft 35 as illustrated in FIG. 4C, and the engagement claw 31 positioned on the opposite side is raised so that the engagement claw 31 is disengaged from the engagement groove 12. In this way, the band 10 can be freely slid. When fingers are separated from the pressing portion 32, the pressing portion 32 returns to its original horizontal state due to elasticity of the synthetic resin.

In the present invention, the slide adjuster 8 is not limited to the above-described structure but may have an optional structure as long as a slide adjuster includes such a buckle and band that an engagement groove is formed in the band, the hook of the buckle elastically engages with the groove, and this engagement state is released frequently by a push button that operates approximately in a vertical direction in relation to the band.

Figure 6:
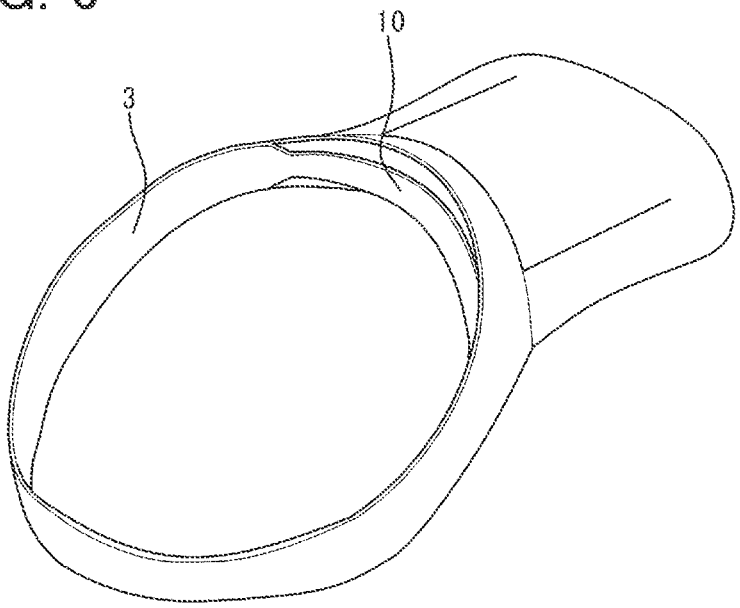
FIG. 6 is a perspective view illustrating a headwear in which a head circumferential portion and a band are integrally molded from a synthetic resin.

Moreover, as illustrated in FIG. 6, the head circumferential portion 3 and the band 10 may be integrally molded from a synthetic resin. In this case, since it is possible to eliminate the labor of fixing the band 10 to the head circumferential portion 3 and to reliably fix the band 10 to the head circumferential portion 3, the headwear can be manufactured more easily.

Hereinafter, an embodiment of the headwear according to the present invention will be described based on the drawings.

Figure 7:
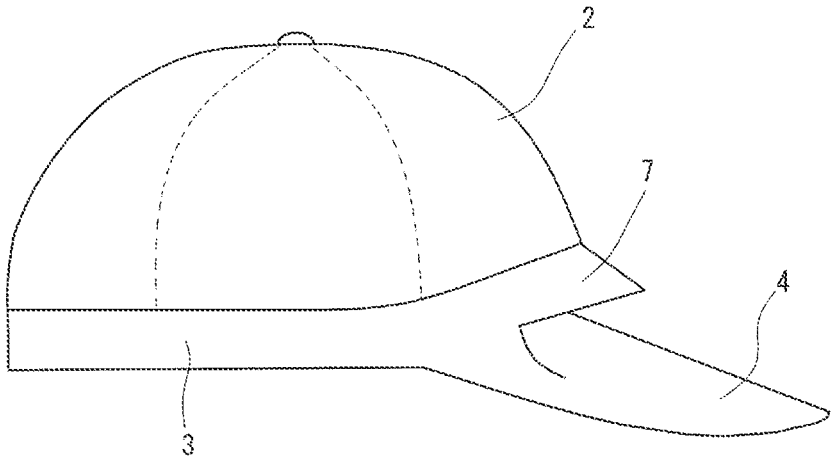
FIG. 7 is a side view of a headwear illustrating another embodiment of the present invention.

FIG. 7 is a side view of a headwear according to the present invention and illustrates a crown 2, a peak 4, and a head circumferential portion 3 that constitute the headwear.

Since the peak 4 and the head circumferential portion 3 are integrally molded and a louver 7 is formed on the peak 4, it is possible to manufacture a louver-attached headwear easily just by fixing the crown 2 to the molded product. A method of fixing the crown 2 is not particularly limited and an optional method that can allow easy fixing and provide strength such as sewing, welding, or attachment using a surface fastener may be used.

The shape and size of the peak 4 are not particularly limited but are appropriately determined by taking the design into consideration as long as the light shading properties can be secured. In the present embodiment, although the peak 4 has a curved shape, the peak 4 may have a planar shape.

The shape and size of the louver 7 formed on the peak 2 are not particularly limited, and optional shape and size may be used as long as air can be introduced to the inner side of the crown 2 along the surface of the peak 2. In the present embodiment, although the louver 7 is formed in an approximately half-moon shape, the louver 7 may have a trapezoidal shape, a circular shape, a rectangular shape, or other various shapes.

Next, the action of the headwear illustrated in FIG. 7 will be described.

Since the louver 7 is formed on the peak 4, outside air is introduced along the surface of the peak 4 from the louver 7 and the louver 7 blocks sunlight entering into the headwear body. According to the headwear of the present invention, since a large amount of outside air flowing from the louver 7 comes into direct contact with the head of the wearer of the headwear and the sunlight is blocked by the louver 7, the wearer can experience an excellent cooling effect.

Moreover, since the head circumferential portion 3 is integrally molded from a synthetic resin, the holding feeling when the headwear of the present invention is worn is improved.

Figure 8:
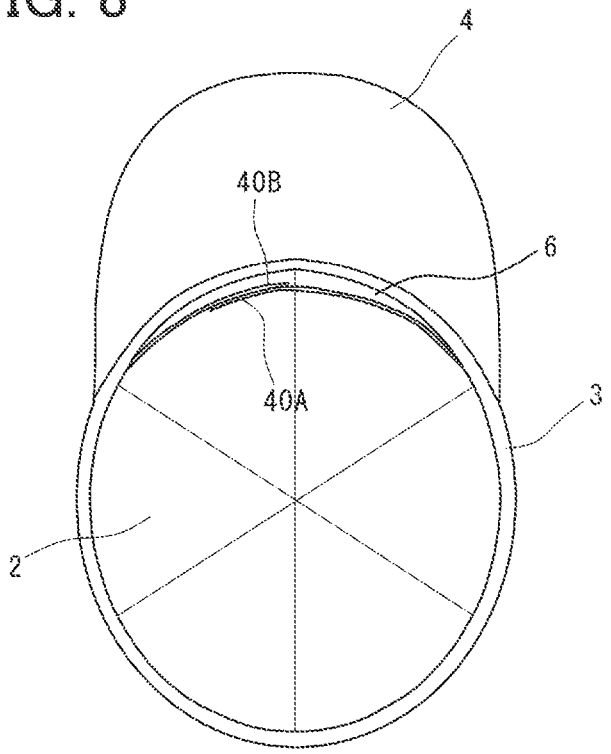
FIG. 8 is a bottom view of the headwear illustrated in FIG. 7.

Since the head circumferential portion 3 is molded from a synthetic resin, the size adjustment belt 9 is provided on the inner side of the crown 2. FIG. 8 is a bottom view of the headwear illustrated in FIG. 7. The size adjustment belt 9 may be molded integrally with the head circumferential portion 3, and an attachment portion may be provided on the inner side of the head circumferential portion 3 so that the size adjustment belt 9 can be attached to the inner side of the head circumferential portion 3. When the size adjustment belt 9 is molded integrally with the head circumferential portion 3, since a step of attaching the size adjustment belt 9 can be eliminated, the efficiency of manufacturing the headwear increases. On the other hand, if the size adjustment belt 9 can be detached from the head circumferential portion 3, the size adjustment belt 9 can be easily replaced when the belt is destroyed or contaminated and one wants to replace the size adjustment mechanism. Since the size adjustment belt 9 is provided on the inner side of the headwear, the size adjustment mechanism is not visible from the outside of the headwear.

When the headwear of the present invention is worn, although the size adjustment belt 9 makes contact with the forehead but the crown 2 does not make contact with the forehead, and a gap 6 is formed between the forehead and the crown 2. Thus, when outside air enters into the crown 2 from the louver 7, the outside air makes direct contact with the forehead and warm air stored inside the crown 2 is discharged outside the crown 2 from the gap 6 with the flow of the outside air. Moreover, since the size adjustment belt 9 makes contact with the forehead, the headwear provides a good wearing feeling (in particular, a fitting feeling). Since the size adjustment belt 9 is provided on the side of the peak 4, the gap 6 is concealed by the peak 4 and a good exterior appearance is provided.

Although materials of the peak 4, the head circumferential portion 3, and the louver 7 are not particularly limited, these portions can be molded from a flexible synthetic resin, and in particular, are preferably molded from an elastic synthetic resin such as polyacetal, polyoxymethylene, polyamide, polycarbonate, or nylon.

Figure 9:
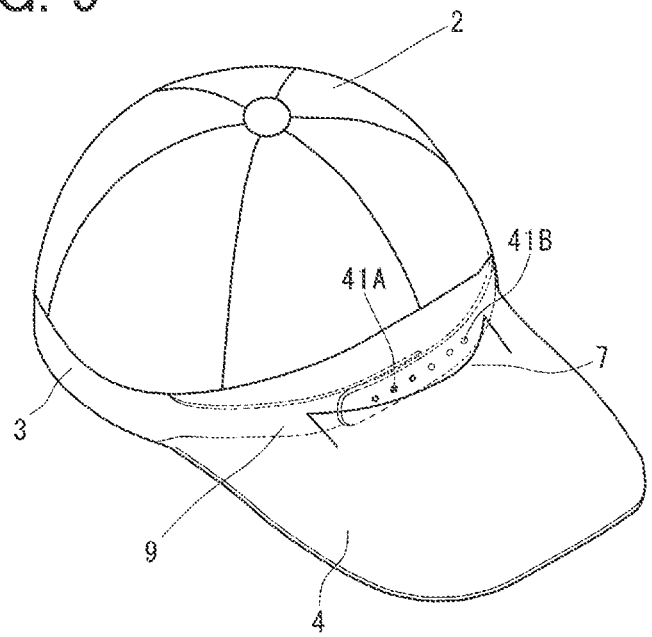
FIG. 9 is a perspective view of a size adjustment belt of the headwear illustrated in FIG. 7.

Next, a size adjustment mechanism of the size adjustment belt 9 of the present embodiment will be described with reference to FIG. 9. FIG. 9 is a perspective view illustrating the size adjustment belt 9 of the headwear illustrated in FIG. 8. The size adjustment mechanism is an american hook-type adjuster in which male hooks 41A are formed in one end 40A of the size adjustment belt 9 and female hooks 41B are formed in the other end 40B. Although the number and interval of the hooks are not particularly limited, approximately seven hooks are formed at an interval of 3 mm to 10 mm.

When one wants to adjust the size, by moving the position at which the male hooks 41A engage with the female hook 41B, the inner circumference of the headwear can be fit to a size desired by the wearer.

Next, another embodiment of the present invention will be described with reference to FIGS. 10A, 10B, and 10C. In the present embodiment, the size adjustment mechanism is configured as a slide adjuster.

Figure 10A:
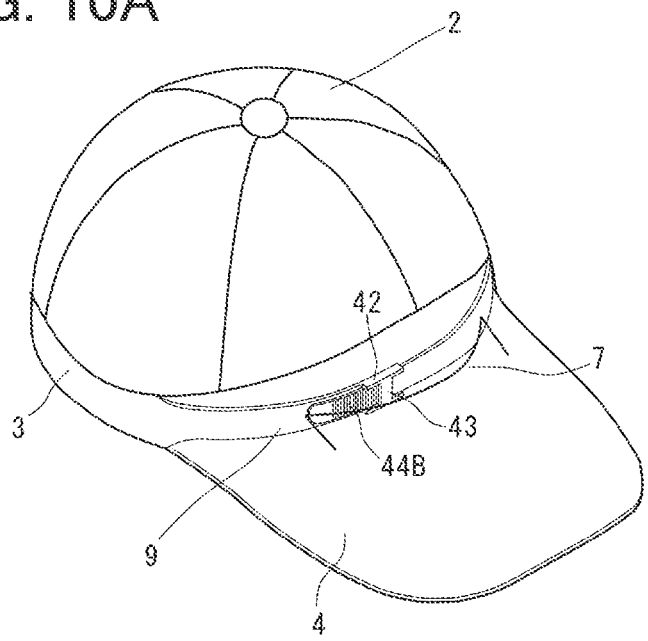
FIGS. 10A, 10B, and 10C are perspective views of a size adjustment belt of a headwear according to another embodiment of the present invention.

FIG. 10A is a perspective view illustrating a size adjustment belt 9 of the headwear of the present embodiment.

Figure 10B:
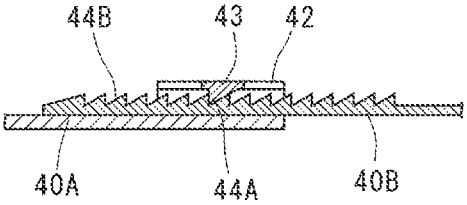
Figure 10C:
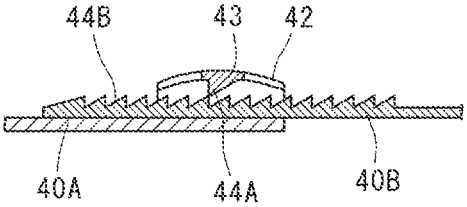

A slide guide 42 is formed in one end 40A of the size adjustment belt 9 and has a portion having such a loop shape that the other end 40B can be inserted, and claw-shaped engagement convex portions 44A are formed on the inner side of a retaining ring 43 of the slide guide 42 as illustrated in FIG. 10B.

On the other hand, engagement concave portions 44B having a sawtooth cross-sectional shape are formed on the outer surface of the other end 40B. In the present embodiment, both ends 40A and 40B are slid so that both engagement portions 44A and 44B engage with each other and the band is adjusted to a length optimal to the wearer. In a state where the claw-shaped engagement convex portions 44A are locked at the engagement concave portions 44B having a sawtooth cross-sectional shape, the other end 40B can freely advance in relation to one end 40A and cannot retract.

The size adjustment belt is formed from vinyl chloride, polyethylene, other flexible synthetic resins, or hard rubber. In this case, the band is preferably molded in advance into a curved surface following the head of the wearer.

Since the size adjustment belt 9 of the present embodiment is configured in the above-described manner, when both ends of the size adjustment belt 9 are retracted, both engagement portions 44A and 44B slide each other, and the other end 40B advances into the slide guide 42, whereby the circumferential length of the size adjustment belt 9 can be decreased. In this state, even when the other end 40B is pulled in a direction of being separated from one end 40A, since both engagement portions 44A and 44B engage with each other, the size adjustment belt 9 is not moved.

On the other hand, when one wants to disengage both engagement portions 44A and 44B to pull the other end 40B from one end 40A, a side portion (in particular, the position of the retaining ring 43) of the slide guide 42 may be pressed by fingers from the outer side so that the retaining ring 43 is bent outward (upward in FIG. 10B). In this case, as illustrated in FIG. 10C, both engagement portions 44A and 44B are disengaged, whereby the other end 40B is retracted from one end 40A, and the band is naturally loosened.

In the size adjustment belt 9 according to the present invention, a method of engaging both ends of the belt is not particularly limited. Besides the above-described embodiment, a surface fastener or the like may be employed.

The invention claimed is:

1. A baseball cap-type headwear comprising:

a peak which comprises an upper end, a lower end, a top surface, and a bottom surface, and which is connected to a front lower end of a head circumferential portion, an outermost point of the front lower end of the head circumferential portion and an uppermost point of the peak defining a void therebetween, and the peak extending laterally in a horizontal direction from an interior to an exterior of the front lower end of the head circumferential portion such that the peak extends beyond the outermost point of the front lower end of the head circumferential portion in the horizontal direction; and a crown which is connected to an upper end of the head circumferential portion, wherein:

a front portion of the head circumferential portion is formed as an inclined surface that widens in an outward direction of the headwear as the inclined surface advances toward a lower end;

the front lower end of the head circumferential portion is connected to both sides of the upper end of the peak, and a central portion of the front lower end of the head circumferential portion is unconnected to a central portion of the upper end of the peak such that the void is formed between the central portion of the upper end of the peak and the central portion of the front lower end of the head circumferential portion;

only the central portion of the upper end of the peak is laterally positioned in the horizontal direction to the interior of the front lower end of the head circumferential portion;

the top surface of the peak is downwardly inclined with respect to a horizontal axis that bisects the void when viewed in side view;

an entirety of the top surface of the peak, extending laterally in the horizontal direction from the interior to the exterior of the front lower end of the head circumferential portion, forms a straight line from the upper end thereof to the lower end thereof when viewed in side view;

an outermost portion of the central portion of the front lower end of the head circumferential portion is positioned entirely above the horizontal axis, and an entirety of the peak, including the central portion of the upper end of the peak, is positioned entirely below the horizontal axis; and at least the front portion of the head circumferential portion and the peak are integrally molded from a synthetic resin.

2. The headwear according to claim 1, wherein the front portion and both sides of the head circumferential portion and the peak are integrally molded from a synthetic resin.

3. The headwear according to claim 1, wherein an entire circumference of the head circumferential portion and the peak are integrally molded from a synthetic resin.

4. The headwear according to claim 1, wherein:

a slide adjuster is provided on an inner side of the head circumferential portion;

the slide adjuster includes a band and a buckle which are formed from a synthetic resin, a sawtooth-shaped engagement groove formed on an outer surface of the band engages with an engagement claw of the buckle, and in an engagement state, the band can freely advance in relation to the buckle but cannot retract;

the buckle includes a buckle body which includes a bottom plate, a roof frame facing the bottom plate, and two side plates connecting the bottom plate and the roof frame, and in which an insertion space for the band is provided;

an operating board is provided horizontally on an inner side of the roof frame and in which the engagement claw is formed on a lower surface of one end thereof so as to engage with the engagement groove of the band, and a pressing portion for disengaging the engagement is provided on the other end;

the operating board is supported by a connecting shaft that is provided at an intermediate position between the engagement claw and the pressing portion so as to connect with one of both side plates and the roof frame such that the operating board can freely swing about the intermediate position; and a height of the pressing portion is equal to or lower than that of the roof frame, and the buckle is fixed to the inner side of the head circumferential portion with the roof frame interposed.

5. The headwear according to claim 4, wherein the band and the head circumferential portion are integrally molded from a synthetic resin.

* * * * *